US005105632A

United States Patent [19]

Naruse

[11] Patent Number: 5,105,632

[45] Date of Patent: Apr. 21, 1992

[54] REFRIGERATION SYSTEM HAVING LIQUEFIED REFRIGERANT CONTROL

[75] Inventor: Nobutaka Naruse, Toyoake, Japan

[73] Assignee: Hoshizaki Denki Kabushiki Kaisha, Toyoake, Japan

[21] Appl. No.: 599,175

[22] Filed: Oct. 17, 1990

[30] Foreign Application Priority Data

Oct. 18, 1989 [JP] Japan ..... 1-270928

[51] Int. Cl.[5] ..... F25C 5/10

[52] U.S. Cl. ..... 62/352; 62/196.4; 62/233

[58] Field of Search ..... 62/278, 352, 196.4, 62/81, 158, 233

[56] References Cited

U.S. PATENT DOCUMENTS

| | | | |
|---|---|---|---|
| 3,332,251 | 7/1967 | Watkins | 62/278 X |
| 3,453,838 | 7/1969 | Decker et al. | 62/196.4 X |
| 3,599,440 | 8/1971 | Melion | 62/278 X |
| 4,899,552 | 2/1990 | Minari | 62/222 X |

FOREIGN PATENT DOCUMENTS 60-13023 4/1982 Japan .

*Primary Examiner*—Albert J. Makay
*Assistant Examiner*—John Sollecito
*Attorney, Agent, or Firm*—Nikaido, Marmelstein, Murray & Oram

[57] ABSTRACT

In a refrigeration system in the form of a refrigerant circulation circuit, a first valve is disposed within a bypass circuit of the circulation circuit for being opened to supply therethrough the hot gas outflowing from a compressor directly into an evaporator. A second valve is interposed between a condenser and the evaporator for being closed to prohibit flow of refrigerant from the condenser into the evaporator therethrough. A first relay is energized to open the second valve when a first detecting element detects finish in cooling of medium caused by thermal exchange with the evaporator. A second relay is energized to close the first valve when a second detecting element detects finish in vaporization of liquefied refrigerant accumulated within the evaporator during cooling of the medium.

4 Claims, 4 Drawing Sheets

REFRIGERATION SYSTEM HAVING LIQUEFIED REFRIGERANT CONTROL

BACKGROUND OF THE INVENTION

1. Field of the Invention

The present invention relates to a refrigeration system adapted for use in ice making machines, refrigerators or the like.

2. Discussion of the Prior Art

In the refrigeration sytem of a conventional ice making machine disclosed in Japanese Utility Model Publication No. 60-13023, a solenoid value of the normally closed type is disposed within a bypass line of the refrigerant circulation circuit to supply therethrough the hot gas outflowing from the refrigerant compressor directly into the evaporator when the solenoid valve has been energized. Such an arrangement of the solenoid valve is useful to dissolve the external surfaces of frozen ice cubes for removal of them during the defrost cycle. It is, however, observed that during the freezing cycle prior to the defrost cycle, frost or ice is grown or formed on outer surfaces of the evaporator to lower temperature of the evaporator. The lowering in temperature of the evaporator decreases an opening degree of an expansion valve to decrease an amount of refrigerant flowing into the evaporator. As a result, flow velocity of refrigerant within the evaporator lowers, and confinement of liquefied refrigerant is facilitated within the evaporator. When accumlated in the evaporator, the liquefied refrigerant is rapidly and concentrically pushed out by the hot gas with high velocity and large amount flowing out from the compressor through the solenoid valve and circulated into the compressor. This results in shortening in life of the compressor and undesired noises caused by hammering the interior of the compressor with the circulated liquefied refrigerant.

In the case that an accumulator is disposed in a line between the evaporator and compressor to store the liquefied refrigerant flowing therein from the evaporator, the amount of gaseous refrigerant to be circulated into the compressor will decrease in accordance with an increase of the liquefied refrigerant in the accumulator. This results in deterioration of the freezing performance of the ice making machine. Furthermore, it is required that for proper restraint in an amount of liquefied refrigerant circulated into the compressor, the accumulator has a large capacity. However, such an arrangement of the accumulator results in an increase of manufacturing cost of the refrigeration system.

SUMMARY OF THE INVENTION

It is, therefore, a primary object of the present invention to provide an improved refrigeration system capable of properly restraining circulation of liquefied refrigerant into the compressor immediately after the freezing cycle without such additional component parts as described above.

According to the present invention, the primary object is attained by providing a refrigeration system in the form of a refrigerant circulation circuit including a compressor, a condenser, an expansion valve and an evaporator arranged for thermal exchange with medium to be cooled, comprising;

a first solenoid valve disposed within a bypass circuit of the refrigerant circulation circuit to supply therethrough the hot gas outflowing from said compressor directly into the evaporator when it has been activated to be opened, a second solenoid valve interposed between the condenser and the evaporator to prohibit flow of refrigerant from the condenser into the evaporator therethrough when it has been activated to be closed, first detecting means for generating a first detecting signal therefrom when detected finish in cooling of the medium caused by thermal exchange with the evaporator, second detecting means for generating a second detecting signal therefrom when detected finish in vaporization of liquefied refrigerant which will be accumulated within the evaporator during cooling of the medium, first activating means responsive to the first detecting signal for activating the second solenoid valve, and second activating means responsive to the second detecting signal for activating the first solenoid valve.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
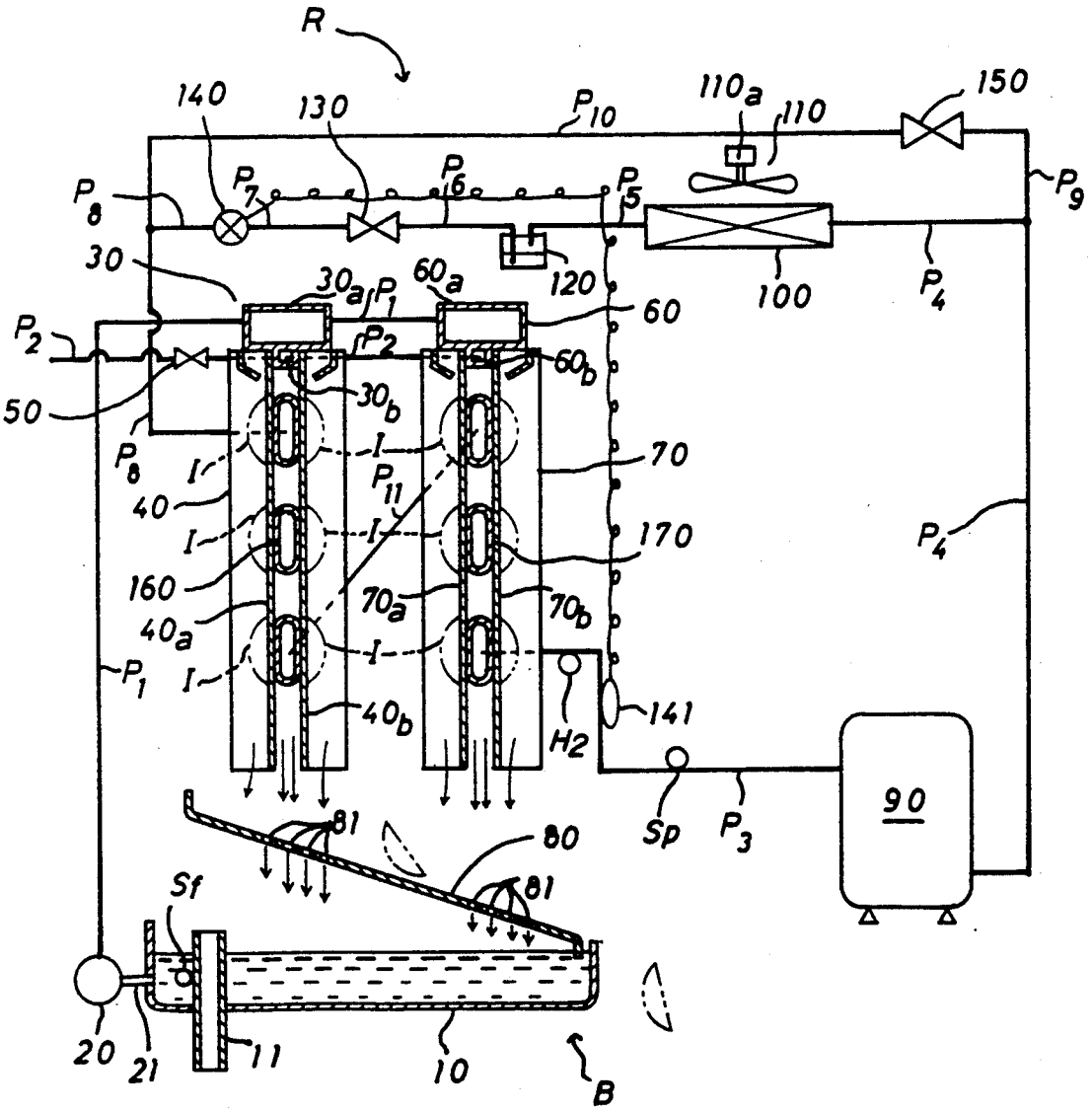
FIG. 1 illustrates a machine body of an ice making machine and a refrigeration system for the ice making machine.
Figure 2:
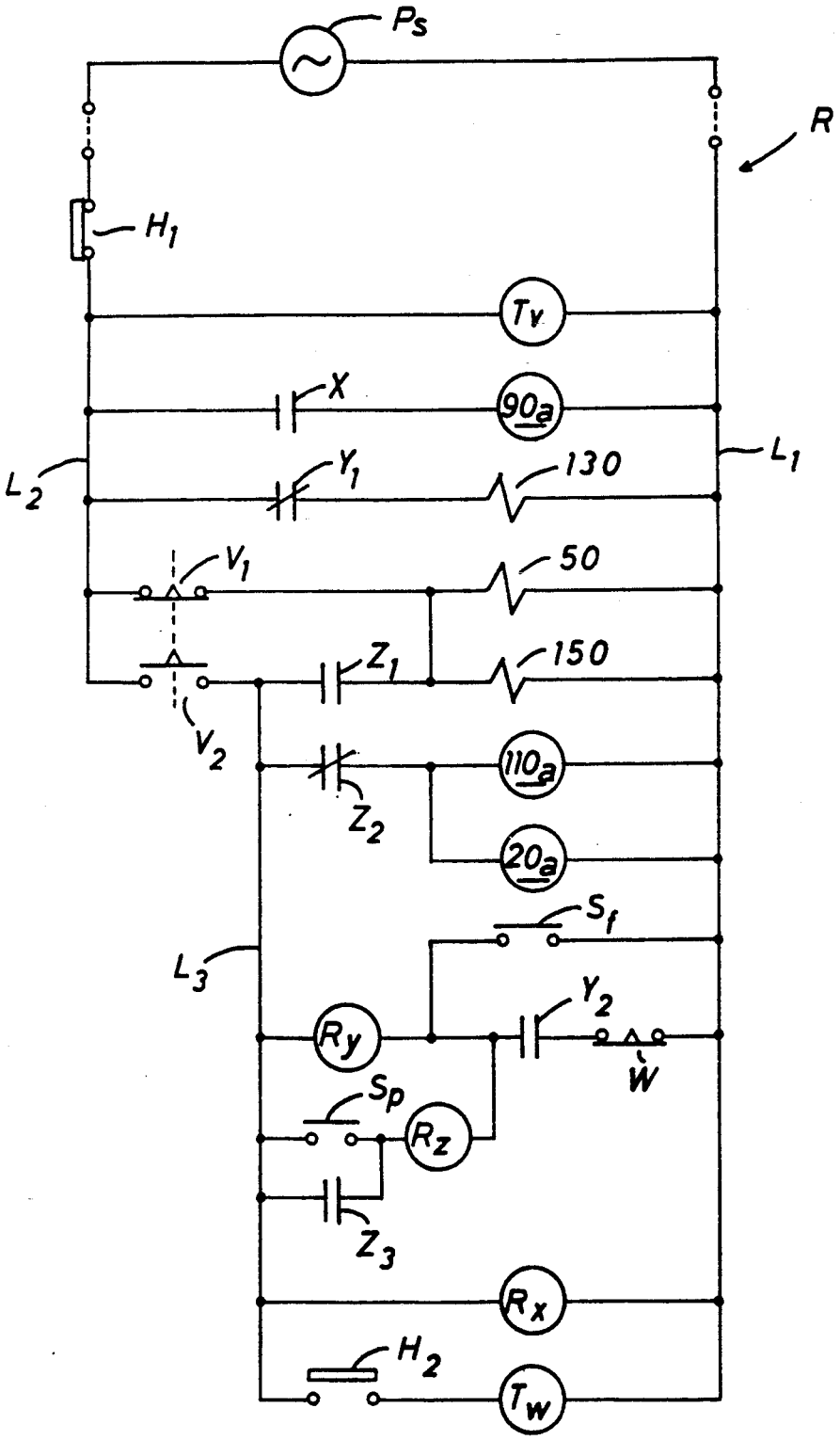
FIG. 2 illustrates an electric control circuit for the ice making machine in accordance with the present invention.

Referring now to FIGS. 1 and 2 of the drawings, there is illustrated an ice making machine in accordance with the present invention which comprises a machine body B and a refrigeration system R. The machine body B includes a water tank 10 in which water is stored, as described later. Within the water tank 10, an overflow pipe 11 is provided to limit an amount of water within the water tank 10 in a predetermined amount.

A water pump 20 is driven by an electric motor 20*a* to pump up water from the water tank 10 through an inlet 21 to supply the under pressure into a line $P_1$. A leftward watering mechanism 30 has watering containers 30*a*, 30*b*. The watering container 30*a* is supplied with the water from the line $P_1$ to render the supplied water flow down along outer surfaces of a pair of ice making plates 40*a*, 40*b* of a leftward upright ice making unit 40 as ice making water. The watering container 30*b* is supplied with water from a source of water (not shown) through a line $P_2$ and a water valve 50 in the form of a normally closed solenoid valve to render the supplied water flow down along inner surfaces of the ice making plates 40*a*, 40*b* as defrost water.

A rightward watering mechanism 60 has a watering containers 60*a*, 60*b*. The watering container 60*a* is supplied with the water from the line $P_1$ to render the supplied water flow down along outer surfaces of a pair of ice making plates 70*a*, 70*b* of a rightward upright ice making unit 70. The watering container 60b is supplied with water from the source of water through the line $P_2$ and the water valve 50 to render the supplied water flow down along inner surfaces of the ice making plates 70a, 70b as defrost water. A perforated water plate 80 is tiltably supported between the water tank 10 and the watering mechanisms 30, 60 to flow the water from the ice making plates down into the water tank 10 through holes 81–81. The water plate 80 receives thereon and guides ice cubes, released from the ice making units, as described later, into an ice stocker (not shown).

The refrigeration system R has a refrigerant compressor 90 which is driven by an electric motor 90a to compress a gaseous refrigerant applied thereto from a refrigerant return line $P_3$ and deliver it through an output line $P_4$ to a finned condenser 100 provided with a cooling fan or blower 110 driven by an electric motor 110a. The condensor 100 cools and liquefies the refrigerant and passes it through a line $P_5$ to a receiver 120 which acts to separate a gaseous phase component from the refrigerant thereby to apply only the liquid phase component of the refrigerant to a line $P_6$.

A solenoid valve 130 of the normally closed type is selectively opened to receive the refrigerant from receiver 120 through the line $P_6$ so as to apply the refrigerant to an expansion valve 140 through the line $P_7$. The expansion valve 140 acts to expand the liquefied refrigerant through line $P_7$ from the solenoid valve 130 and supply it into a line $P_8$. In this instance, the opening degree of expansion valve 140 is controlled in accordance with detecting result of a thermally detecting element 141 which detects temperature of refrigerant in the line $P_3$. A high pressure or hot gas solenoid valve 150 of the normally closed type (hereinafter called as the hot gas valve 150) is disposed between hot gas bypass lines $P_9$, $P_{10}$ respectively extending from intermediate portions of the lines $P_4$, $P_8$. The hot gas valve 150 is selectively opened to supply compressed refrigerant or hot gas under high pressure flowing out through bypass line $P_9$ from the upstream portion of line $P_4$ into the downstream portion of line $P_8$ through bypass line $P_{10}$.

A leftward evaporator coil 160 is supported between the ice making plates 40a, 40b of ice making unit 40 and connected at its upper opening to the downstream portion of the line $P_8$. Thus, the evaporator 160 is supplied with the expanded liquid refrigerant through the line $P_8$ from the expansion valve 140 to freeze water flowing down along the outer surfaces of ice making plates 40a, 40b. The refrigerant from the evaporator coil 160 flows into a line $P_{11}$. The evaporator coil 160 is supplied with hot gas from the hot gas valve 150 through the line $P_{10}$ and the downstream portion of line $P_8$ and warmed by thermal exchange with the hot gas to release frozen ice cubes therefrom. The hot gas from evaporator coil 160 flows into the line $P_{11}$.

A rightward evaporator coil 170 is supported between the ice making plate 70a, 70b of ice making unit 70. The evaporator coil 170 is supplied with the expanded refrigerant from the line $P_{11}$ to freeze water flowing down along the outer surfaces of ice making plates 70a, 70b. The refrigerant from evaporator coil 170 is circulated through return line $P_3$ to the compressor 90. The evaporator coil 170 is supplied with hot gas from line $P_{11}$ and warmed by thermal exchange with the hot gas to release frozen ice cubes therefrom. The hot gas from evaporator coil 170 is circulated into the compressor 90.

An electric control circuit for the refrigeration system R comprises a thermostat $H_1$ of the normally closed type which is opened at a predetermined temperature (for instance, 10° C.) in the ice stocker when the ice stocker is filled with ice cubes. A timer Tv has a timer switch $V_1$ of the normally closed type and a timer switch $V_2$ of the normally open type. The timer Tv is connected at its one terminal to one terminal of a commercially available electric power source Ps through a common line $L_1$ and connected at its other terminal to the other terminal of power source Ps through a common line $L_2$ and the thermostat $H_1$. Thus, the timer Tv is supplied with an AC voltage through the thermostat $H_1$ from the power source Ps to measure a predetermined water supply time duration (for in tance 3 minutes). Upon finishing measurement of the predetermined water supply time duration, the timer Tv acts to open the timer switch $V_1$ and close the timer switch $V_2$. The closure of the timer switch $V_2$ is maintained after finish of the measurement in the timer Tv and released responsive to disconnection of the timer Tv from power source Ps caused by opening of thermostat $H_1$. When maintained in its closed position, the timer switch $V_1$ supplies the AC voltage from power source Ps through the common lines $L_1$, $L_2$ to the water and hot gas valves 50 and 150 so as to open the same valves.

A timer Tw has a timer switch W of the normally closed type and connected at its one terminal to the one terminal of power source Ps through the common line $L_1$. The other terminal of timer Tw is connected to the other terminal of power source Ps through a thermostat $H_2$ of the normally open type, a common line $L_3$, the timer switch $V_2$, the common line $L_2$ and the thermostat $H_1$. Thus, the timer Tw is supplied with the AC voltage from power source Ps in response to closure of the thermostat $H_2$ during closure of the thermostat $H_1$ and timer switch $V_2$ to measure a predetermined defrost time duration (for instance, 2 minutes). Upon finishing measurement of the predetermined defrost time duration, the timer Tw acts to open the timer switch W and to maintain opening of timer switch W after finish of its measurement. The timer Tw is disconnected from the power source Ps by opening of thermostat $H_2$ to close the timer switch W. The thermostat $H_2$ is mounted on a portion of line $P_3$ near the outlet of evaporator 70 to close when detects rise of temperature of refrigerant within the portion of line $P_3$ up to a predetermined defrost temperature (for instance, 9° C.).

A relay coil Rx is associated with a relay switch X of the normally open type to provide a relay. The relay coil Rx is connected at its one end to the one terminal of power source Ps throught the common line $L_1$ and connected at its other end to the other terminal of power source Ps through the common line $L_3$, timer switch $V_2$, common line $L_2$ and thermostat $H_1$. Thus, the relay coil Rx is energized responsive to the AC voltage from power source Ps to close the relay switch X which supplies the AC voltage from the power source Ps through the thermostat $H_1$ to the motor 90a so as to drive it.

A relay coil Ry is associated with a relay switch $Y_1$ of the normally closed type and a relay switch $Y_2$ of the normally open type to provide a relay. The relay coil Ry is connected at its one end to the one terminal of power source Ps through a float switch Sf of the normally open type and the common line $L_1$ and connected at its other end to the other terminal of power source Ps through the common line $L_3$, timer switch $V_2$, common line $L_2$ and thermostat $H_1$. Thus, the relay coil Ry is energized by the AC voltage supplied thereto from power source Ps in response to closing of the float switch Sf during closure of the thermostat $H_1$ and timer switch $V_2$ to open the relay switch $Y_1$ and to close the relay switch $Y_2$. The relay switch $Y_1$ is conditioned in its closure to supply the AC voltage from power source Ps through the thermostat $H_1$ to the solenoid valve 130 so as to open it. Meanwhile, the relay switch $Y_2$ holds energization of relay coil Ry in its closing during closure of timer switch W. The float switch Sf is arranged to close when detects lowering of a level of water within the water tank 10 down to a predetermined low level. The predetermined low level defines an amount of water remained within the water tank 10 when the ice making machine has finished freezing operation thereof.

A relay coil Rz is associated with relay switches $Z_1$, $Z_3$ of the normally open type and a relay switch $Z_2$ of the normally closed type to provide a relay. The relay coil Rz is connected at its one end to the one terminal of power source Ps through a parallel circuit of the float switch Sf and a series circuit of the relay and timer switches $Y_2$, W and the common line $L_1$. The other end of relay coil Rz is connected to the other terminal of power source Ps through a parallel circuit of the relay switch $Z_3$ and a normally open pressure switch Sp, the common line $L_3$, the timer switch $V_2$, the common line $L_2$ and the thermostat $H_1$. When supplied with the AC voltage from power source Ps in response to closing of the pressure switch Sp during closure of the thermostat $H_1$ and the timer and float switch $V_2$ and Sf, or the thermostat $H_1$ and the timer and relay switch $V_2$, W and $Y_2$, the relay coil Rz is energized to close the relay switches $Z_1$, $Z_3$ and to open the relay switch $Z_2$.

When the relay switch $Z_1$ is maintained in its closed position the water and hot gas valve 50 and 150 are energized by the AC voltage applied thereto from power source Ps through the thermostat $H_1$ and timer switch $V_2$ to be opened. The relay switch $Z_2$ is conditioned in its closure to supply the AC voltage from power source Ps to the motors 20*a*, 110*a* through the thermostat $H_1$ and timer switch $V_2$ so as to drive them. The relay switch $Z_3$ is conditioned in its closure to hold the abovementioned energization of the relay coil Rz during closure of the relay and timer switches $Y_2$, W after opening of the pressure switch Sp. The pressure switch Sp is arranged to close when detects lowering in pressure of refrigerant within the line P3 down to a predetermined low pressure. The predetermined low pressure defines decreases in an amount of liquefied refrigerant within the evaporators 160, 170 down to a permissible amount which does not give undesired influence to the compressor 90.

Assuming that there is no ice cube within the ice stocker of the ice making machine, the thermostat $H_1$ is maintained in its closure. When supplied with the AC voltage from power source Ps through the thermostat $H_1$ and the common lines $L_1$, $L_2$ at a time $t=t_0$ (see FIG. 3), the timer Tv starts to measure the predetermined water supply time duration. Simultaneously, the solenoid valve 130 is supplied with the AC voltage from the power source Ps through the relay switch $Y_1$ to be opened, and the water and hot gas valves 50 and 150 are supplied with the AC voltage from the power source Ps through the timer switch $V_1$ to be opened with each other.

When the water valve 50 is opened, the watering containers 30*b*, 60*b* are supplied with water from the source of water through the line $P_2$. The water from the watering containers 30*b*, 60*b* flows down along the ice making units 40, 70 and then flows into the water tank 10 through the holes 81 of water plate 80 as ice making water. When the timer Tv finishes measurement of the predetermined water supply time duration at time $t=t_1$ (see FIG. 3), the timer switch $V_1$ is opened, whereas the timer switch $V_2$ is closed. Then, the water valve 50 is disconnected by the opened timer switch $V_1$ from the power source Ps to close so as to stop flow of water into the water tank 10. In addition, the hot gas valve 150 is also closed together with the water valve 50.

When the timer switch $V_2$ is closed, the motors 20*a*, 110*a* are supplied with the AC voltage from the power source Ps through the thermostat $H_1$ and relay switch $Z_2$ to be activated so as to drive the water pump 20 and the cooling fan 110. Simultaneously, the relay coil Rx is supplied with the AC voltage from power source Ps through the thermostat $H_1$ to be energized so as to close the relay switch X. Thus, the motor 90*a* is supplied with the AC voltage from power source Ps through the thermostat $H_1$ and relay switch X so that it is activated to drive the compressor 90 (see FIG. 3).

When the water pump 20 is driven, the water within the water tank 10 is supplied into the water containers 30*a*, 60*a* through the line $P_1$ and then flows down along the outer surfaces of ice making plates of ice making units 40, 70 into the water tank 10 through the perforated water plate 80. When the cooling fan 110 and compressor 90 are driven, the gaseous refrigerant from line $P_3$ is compressed by the compressor 90 and delivered through line $P_4$ to condenser 100. Then, the gaseous refrigerant is cooled and liquefied by the condenser 100 under cooling operation of fan 110 and supplied to the receiver 120 through line $P_5$. Subsequently, the receiver 120 acts to separate a gaseous phase component from the refrigerant to apply only the liquid phase component of the refrigerant through the line $P_6$, the solenoid valve 130 and the line $P_7$ to the expansion valve 140. Therefore, the expansion valve 140 acts to expand the liquid refrigerant in accordance with an opening degree given by the detecting result of the thermal sensing element 141.

Then, the evaporator 160 is supplied with the expanded refrigerant from the expansion valve 140 through the line $P_8$ to freeze the water flowing down along the outer surfaces of ice making plates 40*a*, 40*b* of ice making unit 40. The evaporator 170 is supplied with the refrigerant from evaporator 160 through the line $P_{11}$ to freeze the water flowing down along the outer surfaces of ice making plates 70*a*, 70*b* of ice making unit 70. The refrigerant flowing out from the evaporator 170 is circulated into the compressor 90 through the return line $P_3$. This means that the ice making machine is conditioned in its freezing cycle (see FIG. 3). In addition, the timer Tw is supplied with the AC voltage from the power source Ps through the closed thermostats $H_1$, $H_2$ in response to closing of the timer switch $V_2$ to measure the predetermined defrost time duration so as to open the timer switch W upon finishing measurement thereof.

Figure 3:
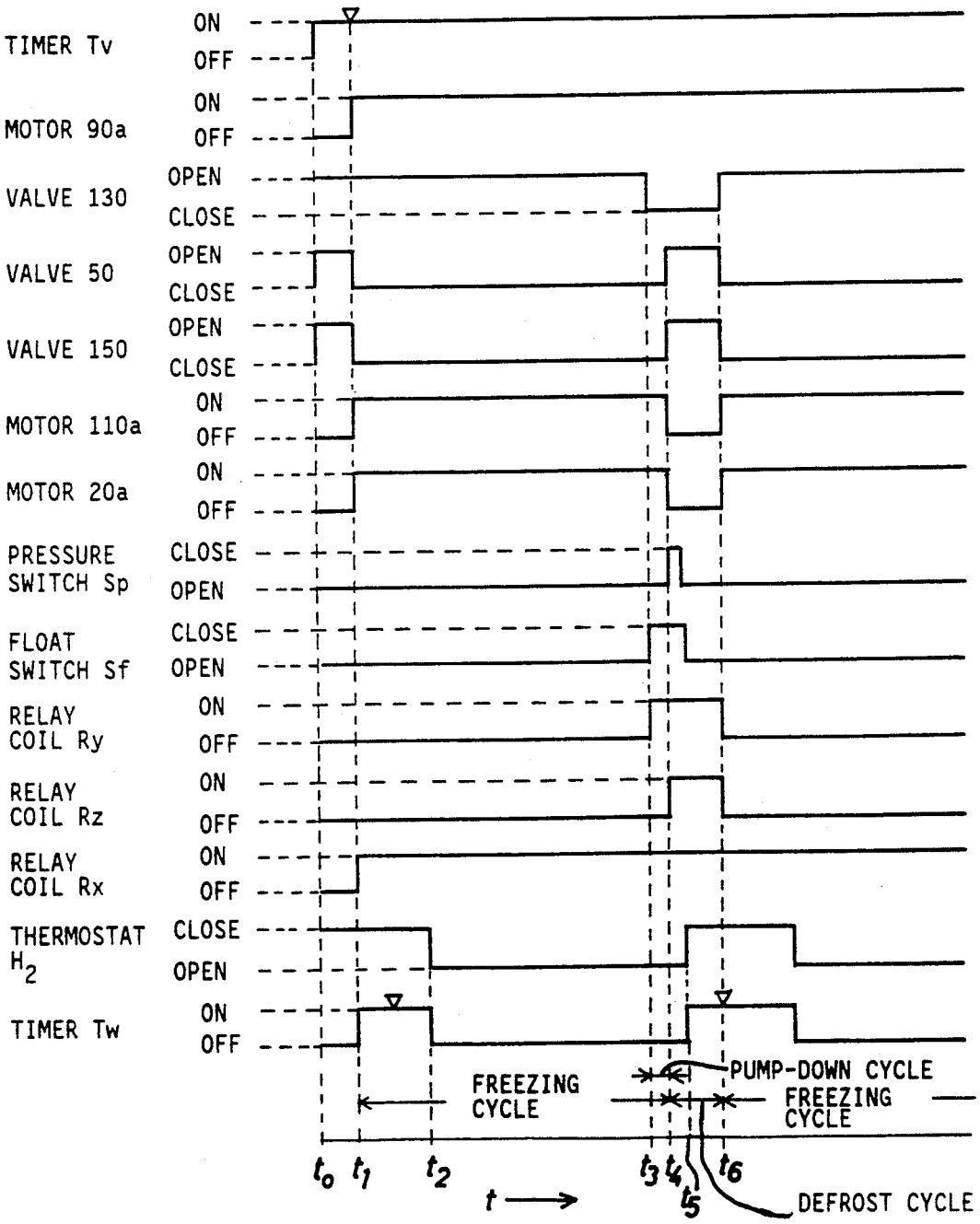
FIG. 3 is a time chart explaining operation of various components of the ice making machine.

When the water flowing down along the outer surfaces of the ice making plates of ice making units 40, 70 is progressively frozen by the evaporators 160, 170 into ice cubes I shown by dotted lines of FIG. 1 during repetitive freezing cycles of the ice making machine, the water level in water tank 10 will gradually lower to the predetermined level at which the float switch Sf is closed (see $t=t_3$ in FIG. 3). Furthermore, temperature of refrigerant in line $P_3$ will gradually lower, resulting in opening of the thermostat $H_2$. Thus, the timer Tw is disconnected from power source Ps to close the timer switch W (see $t=t_2$ in FIG. 3).

When supplied with the AC voltage from power source Ps through the thermostat $H_1$ in response to closing of the float switch Sf, the relay coil Ry is energized to open the relay switch $Y_1$ and to close the relay switch $Y_2$ (see $t=t_3$ in FIG. 3). Then, the solenoid valve 130 is disconnected from power source Ps in response to opening of the relay switch $Y_1$ to be deenergized such that it is closed to prohibit flow of refrigerant from line $P_6$ to line $P_7$. Additionally, the relay coil Ry is maintained in its energized condition by the closed relay and timer switches $Y_2$, W.

When the flow of refrigerant from line $P_6$ to line $P_7$ is prohibited by the solenoid valve 130, the ice making machine is conditioned in a pump-down cycle or refrigerant recovery cycle (see FIG. 3). In the pump-down cycle, liquefied refrigerant accumulated in the evaporators 160, 170 in accordance with lowering of the temperature of the evaporators 160, 170 during the freezing cycle lowers gradually in its pressure under operation of the compressor 90 and then is gradually vaporized. Meanwhile, the water supplied to the containers under operation of water pump 20 flows down continuously along the ice making plates of ice making units 40, 70, resulting in restraint of overfreezing the ice making plates 40, 70 and ice cubes I. This facilitates vaporization of liquefied refrigerant within the evaporators 160, 170 during the pump-down cycle and release of ice cubes I during the following defrost cycle.

When the pressure switch Sp is closed in response to lowering in pressure of refrigerant within line $P_3$ caused by vaporization of the liquefied refrigerant within the evaporators 160, 170, the relay coil Rz is energized by the AC voltage supplied thereto from the power source Ps through the thermostat $H_1$, timer switch $V_2$, relay switch $Y_2$ and timer switch W to close the relay switches $Z_1$, $Z_3$ and to open the relay switch $Z_2$ (see $t=t_4$ in FIG. 3). Then, the water and hot gas valves 50, 150 are supplied with the AC voltage from the power source Ps through the thermostat $H_1$ and timer switch $V_2$ in response to closing of the relay switch $Z_1$ to be opened. This means that the ice making machine is conditioned in a defrost cycle (see FIG. 3). In this instance, the motors **20*a*, 110*a* are deactivated in response to opening of the relay switch $Z_2$ to stop the water pump 20 and cooling fan 110**. In addition, the energization of relay coil Rz is maintained by the closed relay switch $Z_3$.

When the ice making machine is conditioned in the defrost cycle, the watering containers **30*b*, 60*b* are supplied with water through the line $P_2$ from the source of water by the opened water valve 50. Then, the water from containers 30*b*, 60*b* flows down along the inner surfaces of the ice making plates of ice making units 40, 70. Meanwhile, the hot gas outflowing from compressor 90 is supplied in pressure by the opened hot gas valve 150 directly to the evaporators 160, 170 through the lines $P_4$, $P_9$, $P_{10}$ and the downstream portion of line $P_8$. Thus, the ice making plates of units 40, 70 are warmed by thermal exchange with the water flowing down along the ice making plates and the hot gas flowing through the evaporators 160, 170**. This effects dissolution of the external surfaces of the frozen ice cubes I.

As is understood from the above description, the liquefied refrigerant within the evaporators 160, 170 is vapourized during the pump-down cycle prior to the defrost cycle. This reliably prevents circulation of liquefied refrigerant from the evaporators 160, 170 into the compressor 90 immediately after start of the defrost cycle. Thus, only the hot gas supplied into the evaporators 160, 170 is circulated through the line $P_3$ into the compressor 90 during the following defrost cycle. This reliably prevents shortening in life of the compressor 90 caused by circulation of liquefied refrigerant into the compressor 90 and also prevents undesired noises caused by hammering the interior of the compressor 90 with the liquefied refrigerant circulated thereto. These effects may be attained without any arrangement of an accumulator, resulting in a decrease of manufacturing cost of the ice making machine and circulation of an enough amount of refrigerant into the compressor 90.

When the thermostat $H_2$ is closed at time $t=t_5$ (see FIG. 3) in accordance with rise of the temperature of refrigerant within the line $P_3$, the timer Tw is again supplied with the AC voltage from power source Ps to measure the predetermined defrost time duration, as previously described. In this instance, the float switch Sf is opened in accordance with flow of water into the water tank 10 through the perforated water plate 80 after start of the defrost cycle, and the pressure switch Sp is opened in accordance with flow of refrigerant in pressure into the line $P_3$. When the timer switch W is opened in response to finish of measurement of the timer Tw (see $t=t_6$ in FIG. 3), the relay coils Ry, Rz are disconnected from the power source Ps to be deenergized. Thus, the defrost cycle is ended, and the ice cubes I released from the ice making units 40, 70 fall down and are guided by the water plate 80 into the ice stocker.

When the relay coils Ry, Rz are deenergized the relay switch $Y_1$ is closed to open the solenoid valve 130. Simultaneously, the relay switch $Z_1$ is opened to close the water and hot gas valves 50 and 150, and the relay switch $Z_2$ is closed to activate the water pump 20 and the cooling fan 110. This means that the ice making machine is again conditioned in the freezing cycle. Therefore, the ice making machine repeats the freezing cycle, the pump-down cycle and the defrost cycle in sequence, as previously described. When the ice stocker is filled with ice cubes I, the thermostat $H_1$ is opened, and the ice making machine stops in response to opening of the thermostat $H_1$.

Figure 4:
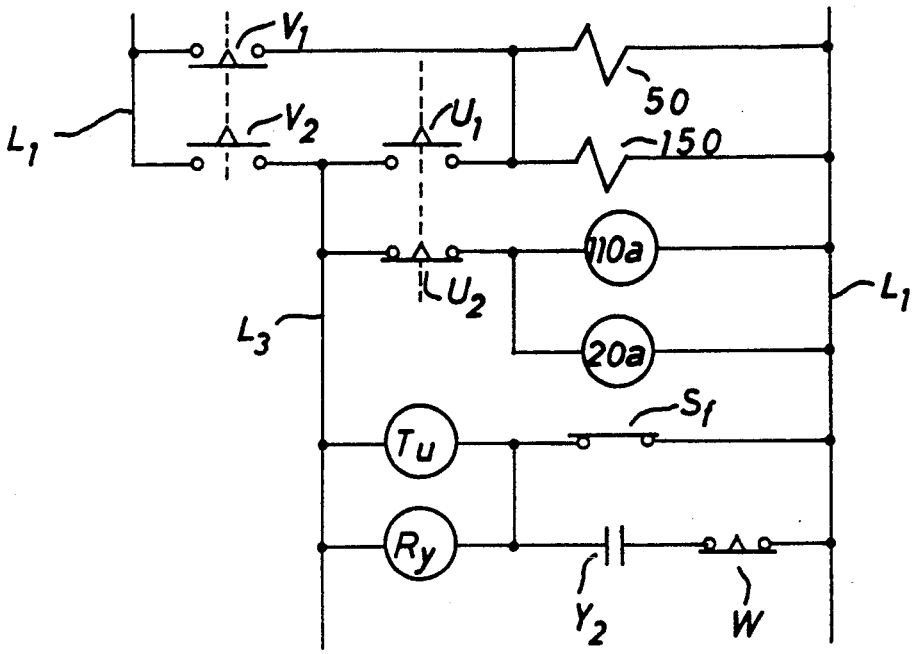
FIG. 4 illustrates a modification of the electric control circuit shown in FIG. 2.

FIG. 4 illustrates a modification of the previous embodiment which is characterized in that the relay coil Rz and the pressure and relay switches Sp, $Z_1$, $Z_2$ and $Z_3$ described in the previous embodiment are replaced with a timer Tu with a timer switch $U_1$ of the normally open type and a timer switch $U_2$ of the normally closed type. The timer Tu is connected at its one end to the common line $L_3$. The other end of timer Tu is connected to the common line $L_1$ through the float switch Sf. Then, the timer Tu is supplied with the AC voltage from the common lines $L_1$, $L_3$ through the float switch Sf or the relay and timer switches $Y_2$, W to measure a predetermined measuring time duration. Upon finish of measurement of the predetermined measuring time duration, the timer Tu closes the timer switch $U_1$, opens the timer switch $U_2$ and maintains closing of the timer switch $U_1$ and opening of the timer switch $U_2$. The timer switch $U_1$ is maintained in its closure to permit supply of the AC voltage from power source Ps to the water and hot gas valves 50, 150 through the timer switch $V_2$. The timer switch $U_2$ is maintained in its closure to permit supply of the AC voltage from power source Ps to the motors 20*a*, 110*a* through the timer switch $V_2$. In the modification, the predetermined measuring time duration corresponds to a time duration necessary for lowering of refrigerant pressure within the line $P_3$ down to the predetermined low pressure after closing of the float switch Sf. Other construction of the modification is the same as that of the previous embodiment.

Figure 5:
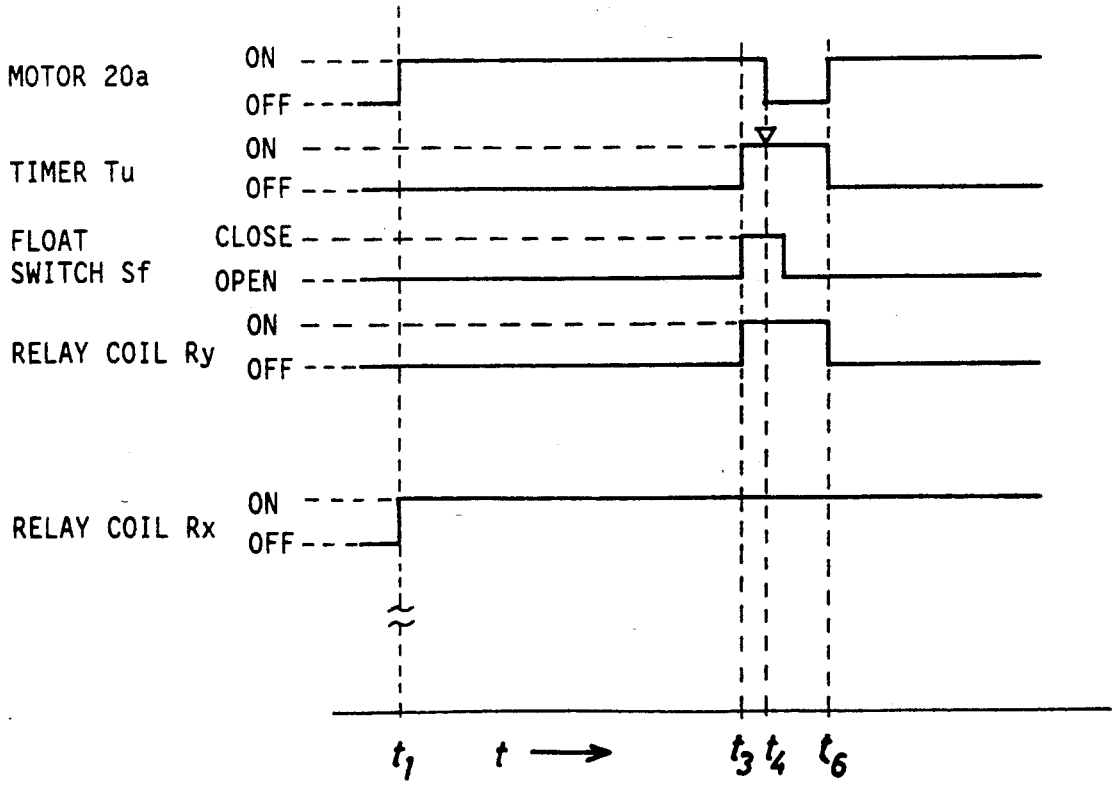
FIG. 5 is a time chart explaining operation of main components of the modification.

In the modification, when the float switch Sf is closed, as described in the previous embodiment, the relay coil Ry is energized and simultaneously the timer Tu measures the predetermined measuring time duration (see $t=t_3$ in FIG. 5). When the timer Tu finishes measurement thereof at $t=t_4$ in a condition wherein liquefied refrigerant accumulated within the evaporators 160, 170 was already vapourized during the pump-down cycle, as previously described, the timer switch $U_1$ is closed, whereas the timer switch $U_2$ is opened. Then, the water and hot gas valves 50 and 150 are supplied with the AC voltage from power source Ps in response to closing of the timer switch $U_1$, whereas the motors 20*a*, 110*a* are deactivated in response to opening of the timer switch $U_2$ to stop the water pump 20 and the cooling fan 110. Thus, the ice making machine finishes the pump-down cycle, as previously described.

From the above description, it will be understood that the liquefied refrigerant accumulated within the evaporators 160, 170 are vaporized at the pump-down cycle of the ice making machine during measurement of the timer Tu, in case of replacement of the relay coil Rz and pressure and relay switches Sp, $Z_1$, $Z_2$, $Z_3$ with the timer Tu having the timer switches $U_1$, $U_2$. This reliably prevents circulation of liquefied refrigerant into the compressor 90 immediately after start of the defrost cycle of the ice making machine.

The present invention may be adapted to various refrigeration system having a hot gas valve.

In actual practices of the present invention, the solenoid valve 130 of the normally close type may be replaced with a solenoid valve of the normally open type. Furthermore, the solenoid valve 130 may be also interposed between the downstream portion of the line $P_8$ and the condenser 100. In addition, the expansion valve 140 may be replaced with, for instance, a capillary tube, Having now fully set forth structure and operation of preferred embodiments of the concept underlying the present invention, various other embodiments as well as certain modifications and variations of the embodiments shown and described herein will obviously occur to those skilled in the art becoming familiar with the underlying concept. It is to be understood, therefore, that within the scope of the appended claims, the invention may be practiced otherwise than as specifically set forth herein.

What is claimed is:

1. A refrigeration system having a refrigerant circulation circuit including a compressor, a condenser, an expansion valve and an evaporator arranged for thermal exchange with medium to be cooled, comprising:

a first solenoid valve disposed within a bypass circuit of said refrigerant circulation circuit to supply therethrough a hot gas outflowing from said compressor directly into said evaporator when it has been activated to be opened, a second solenoid valve interposed betweem said condenser and said evaporator to prohibit the flow of liquefied refrigerant passing therethrough from said condenser into said evaporator when it has been activated to be closed, first detecting means for generating a first detecting signal therefrom when detected finish in freezing of the medium caused by thermal exchange with said evaporator, second detecting means for generating a second detecting signal therefrom when detected finish in vaporization of liquefied refrigerant accumulated within said evaporator during freezing of the medium, first activating means responsive to the first detecting signal for activating said second solenoid valve in a condition where the medium is subsequently coled by thermal exchange with said evaporator under continuous operation of said compressor, and second activating means responsive to the second detecting signal for activating said first solenoid valve immediately after deactivation of said second solenoid valve.

2. A refrigeration system as claimed in claim 1, wherein said second solenoid valve is interposed between said expansion valve and a receiver arranged downstream of said condenser.

3. A refrigeration system as claimed in claim 1, wherein said second detecting means includes a pressure detecting element for detecting the pressure of refrigerant circulated from said evaporator into said compressor and for generating a second detecting signal therefrom when the detected pressure of refrigerant becomes lower than a predetermined value during activation of said second solenoid valve, and wherein said second activating means is responsive to the second detecting signal from said pressure detecting element for activating said first solenoid valve.

4. A refrigeration system as claimed in claim 1, wherein said first activating means includes relay means for activating said second solenoid valve when energized in response to the first detecting signal, and wherein said second activating means includes relay means for activating said first solenoid valve when energized in response to the second detecting signal detecting element.

* * * * *